US005628043A

United States Patent [19]

Ikeda et al.

[11] Patent Number: 5,628,043

[45] Date of Patent: May 6, 1997

[54] IMAGE FORMING APPARATUS

[75] Inventors: Masae Ikeda; Kunihiko Sato; Hiroyasu Ishijima; Yoshimi Takizawa, all of Kanagawa, Japan

[73] Assignee: Fujitsu Limited, Kawasaki, Japan

[21] Appl. No.: 602,692

[22] Filed: Feb. 16, 1996

Related U.S. Application Data

[63] Continuation of Ser. No. 306,416, Sep. 15, 1994, abandoned.

[30] Foreign Application Priority Data

Sep. 20, 1993 [JP] Japan ..... 5-232121

[51] Int. Cl.[6] ..... G03G 15/08

[52] U.S. Cl. ..... 399/281; 399/236

[58] Field of Search ..... 355/245, 259; 118/653, 661, 656

[56] References Cited

U.S. PATENT DOCUMENTS

| | | | |
|---|---|---|---|
| 5,051,332 | 9/1991 | Hosoya et al. | 118/652 X |
| 5,057,871 | 10/1991 | Hirose et al. | 355/259 |
| 5,076,201 | 12/1991 | Nishio et al. | 118/653 |
| 5,095,341 | 3/1992 | Yoshida et al. | 355/259 |
| 5,146,285 | 9/1992 | Kikuchi et al. | 118/653 X |
| 5,148,219 | 9/1992 | Kohyama | 355/269 X |
| 5,168,312 | 12/1992 | Aoto et al. | 355/245 X |
| 5,196,892 | 3/1993 | Mitsuaki | 355/269 |
| 5,239,344 | 8/1993 | Enoki et al. | 118/651 X |
| 5,241,357 | 8/1993 | Iwata | 355/326 |
| 5,245,391 | 9/1993 | Suzuki et al. | 118/653 X |
| 5,247,333 | 9/1993 | Yamamoto et al. | 355/245 |
| 5,317,370 | 5/1994 | Kohyama et al. | 355/245 |
| 5,367,367 | 11/1994 | Ikeda et al. | 355/245 |
| 5,412,458 | 5/1995 | Kamaji et al. | 355/259 |

*Primary Examiner*—Matthew S. Smith
*Attorney, Agent, or Firm*—Armstrong, Westerman, Hattori, McLeland & Naughton

[57] ABSTRACT

An image forming apparatus including an image transport member driven to rotate with a latent image formed on a surface thereof, and a toner transport member driven to rotate with toner attached thereto for developing the latent image and in contact with the image transport member to transport the toner to the image transport member. The image forming apparatus further includes a toner layer thickness regulating member disposed in pressure contact with the surface of the toner transport member to regulate the thickness of a layer of toner transported in a state of being attached to the surface of the toner transport member. The amount of charge of the toner on the surface of the toner transport member is regulated in the range of from −16 μC/g to −19 μC/g.

14 Claims, 7 Drawing Sheets

| TONER CHARGE (μC/g) | -10 ~ -15 | -16 ~ -19 | -20 ~ -25 | -26 ~ -29 |
|---|---|---|---|---|
| FOG DENSITY | C | A | A | B |
| PRINT DENSITY | A | A | B | C |

A: GOOD
B: RATHER BAD
C: BAD

IMAGE FORMING APPARATUS

This application is a continuation of application Ser. No. 08/306,416 filed Sep. 15, 1994, now abandoned.

BACKGROUND OF THE INVENTION

1. Field of the Invention

The present invention relates to an image forming apparatus in which a latent image formed on the surface of an image transport member such as a photosensitive drum is developed by toner transported by a toner transport member such as a developing roller.

This type of image forming apparatus generally uses a mono-component developer which is comprised only of toner containing no carrier particles. It is necessary in order to obtain excellent development quality by using such a mono-component developer to prevent variation of the amount of toner supplied to the image transport member from the toner transport member.

Particularly, in an electrophotographic apparatus designed to form a full-color image by superimposing a plurality of toner images of different colors, if the amount of toner supplied varies from color to color, the color reproducibility is deteriorated, and the image quality is considerably degraded.

2. Description of the Related Art

In an electrophotographic apparatus or other similar image forming apparatus, while toner is being transported in a state of adhering to the surface of a developing roller as a toner transport member, a layer of toner is formed to a predetermined uniform thickness by the action of a layer thickness regulating blade that is disposed in pressure contact with the surface of the developing roller.

The toner layer is transported to the surface of a photosensitive drum as an image transport member by the rotation of the developing roller, and a latent image formed on the surface of the photosensitive drum is developed by the toner. At this time, an amount of toner required for development is ensured by setting the peripheral velocity of the developing roller at a higher level than that of the photosensitive drum.

The amount M of toner Supplied to the photosensitive drum from the developing roller is given by $$M=(Vd/Vp)Dt.a.P.nd$$

where Vd/Vp: the peripheral velocity ratio (the peripheral velocity of the developing roller/the peripheral velocity of the photosensitive drum)

Dt: the toner layer thickness a: the toner density

P: the toner packing rate nd: the development efficiency (the ratio of the amount of toner transported from the developing roller to the photosensitive drum to the amount of toner attached to the developing roller)

Accordingly, it has heretofore been considered from the above expression that the amount of toner supplied to the photosensitive drum can be maintained at a constant level by setting the peripheral velocity ratio such that when the toner layer is relatively thin, the peripheral velocity ratio is set at a relatively high level, whereas, when the toner layer is relatively thick, the peripheral velocity ratio is set at a relatively low level. Thus, the conventional practice has been to set the toner layer thickness and the peripheral velocity ratio in an appropriate relationship, considering only the relationship therebetween, at the time of designing an image forming apparatus.

However, the development efficiency, that is, the ratio of the amount of toner moving to the photosensitive drum to the amount of toner attached to the developing roller, varies according to the amount of toner charge.

Accordingly, when an apparatus is designed by taking into consideration only the relationship between the toner layer thickness and the peripheral velocity ratio, the amount of toner supplied to the photosensitive drum varies with the fluctuation of the development efficiency due to the variation of the amount of toner charge, thus degrading the development quality, particularly the color reproducibility in the case of full-color development.

SUMMARY OF THE INVENTION

An object of the present invention is to provide an image forming apparatus which is designed so that the amount of toner charge shifts only slightly, and hence the development efficiency does not considerably change; as a result, the amount of toner supplied to an image transport member, for example, a photosensitive drum, is stabilized and becomes uniform, thus enabling favorable development quality to be obtained.

A further object of the present invention is to provide an image forming apparatus which can obtain favorable development quality irrelevant to a variation of a material used for a one component toner.

Other objects and advantages of the present invention will become apparent from the following detailed description of illustrated embodiments of the invention.

According to the present invention, there is provided an image forming apparatus including an image transport member driven to rotate with a latent image formed on a surface thereof, and a toner transport member driven to rotate with toner attached thereto for developing the latent image and in contact with the image transport member to transport the toner to the image transport member. The image forming apparatus further includes a toner layer thickness regulating member disposed in pressure contact with the surface of the toner transport member to regulate the thickness of a layer of toner transported in a state of being attached to the surface of the toner transport member. The amount of charge of the toner on the surface of the toner transport member is regulated in the range of from −16 μC/g to −19 μC/g.

BRIEF DESCRIPTION OF THE DRAWINGS

The present invention may be more fully understood from the description of preferred embodiments of the invention set forth below, together with the accompanying drawings, in which.

DESCRIPTION OF THE PREFERRED EMBODIMENTS

Embodiments of the present invention will be described below with reference to the accompanying drawings.

Figure 1:
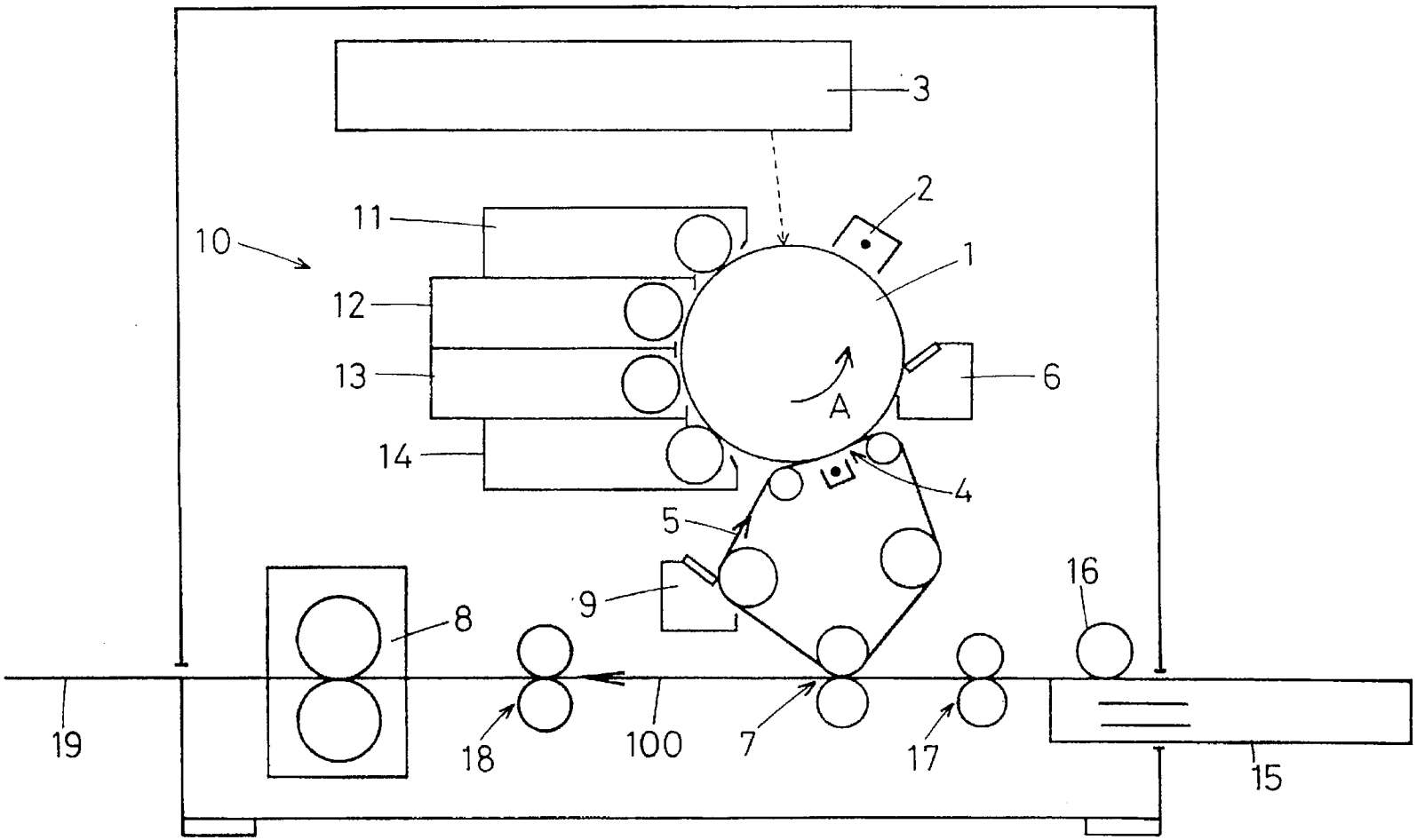
FIG. 1 shows the general arrangement of a color printer according to a first embodiment of the present invention.

FIG. 1 shows an electrophotographic full-color printer to which the present invention is applied. However, it should be noted that the present invention may also be applied to monochromatic printers and various other image forming apparatuses of the type in which a latent image is developed by toner.

The printer has a developing section 10 which is provided with four developing units 11, 12, 13 and 14 for carrying out development with four different toners, which have different colors, that is, yellow, magenta, cyan, and black.

When recording is to be effected, the surface of a photosensitive drum (image transport member) 1 is first charged to a minus voltage, e.g., of the order of −600 V, by a charger 2. Subsequently, the surface of the photosensitive drum 1 is exposed to an image beam emitted from a laser optical unit 3. Consequently, only the exposed portion on the surface of the photosensitive drum 1 changes in electric potential to about −80 V, for example, and thus an electrostatic latent image of information to be recorded is formed on the surface of the photosensitive drum 1.

The photosensitive drum 1 is driven to rotate in the direction of the arrow A at a predetermined speed. At the developing section 10, the color toners are selectively attached to the electrostatic latent image on the photosensitive drum 1. In this embodiment, the yellow toner, which is supplied from the first developing unit 11, is first used.

At a transport section 4, the toner image on the photosensitive drum 1 is transferred to an intermediate transfer belt 5. After the transfer, the photosensitive drum 1 is cleaned at a cleaner section 6 to remove the residual toner. Thereafter, the image forming process is repeated.

In the subsequent process, that is, the second revolution of the photosensitive drum 1, development is carried out using the magenta toner, which is supplied from the second developing unit 12, in place of the yellow toner. The resulting magenta toner image is superimposed over the first yellow toner image on the intermediate transfer belt 5 so that the two toner images are in register with each other. Thereafter, a cyan toner image and a black toner image are successively superimposed over the yellow and magenta toner images on the intermediate transfer belt 5 in the same way as the above. Upon completion of the superimposition of the four color toner images on the intermediate transfer belt 5, the toner images are transferred together to a sheet of recording paper 100 at a second transfer section 7.

The recording paper 100 is delivered from a paper cassette 15 by a pickup roller 16 and sent to the second transfer section 7 by a paper transport roller 17. The recording paper 100 is further sent to a fuser 8 by another paper transfer roller 18. In the fuser 8, the recording paper 100 is held between a pair of rollers so that it is transported while being heated. Thus, the toner is fused to fix on the recording paper 100.

After the transfer of the toner images to the recording paper 100, the intermediate transfer belt 5 gets rid of the residual toner at a cleaner section 9 so as to be reused for recording. By repeating the above-described operation, a full-color image is recorded on the recording paper 100.

In the electrophotographic full-color printer, a plurality of the developing units 11, 12, 13 and 14 are provided around the photosensitive drum 1. Among the toners used in the respective developing unit, a composition of a toner is different from that of another toner in accordance with a color of the toner and/or manufacturing lots. In that case, an amount of charge of a toner is different from that of another toner.

Then, a tone of a color might be variant dependent upon a change of a amount of charge of a toner. Furthermore, the undesirable developing of a background area on a photosensitive drum 1 will result in an undesirable mixing of a developed color.

Figure 2:
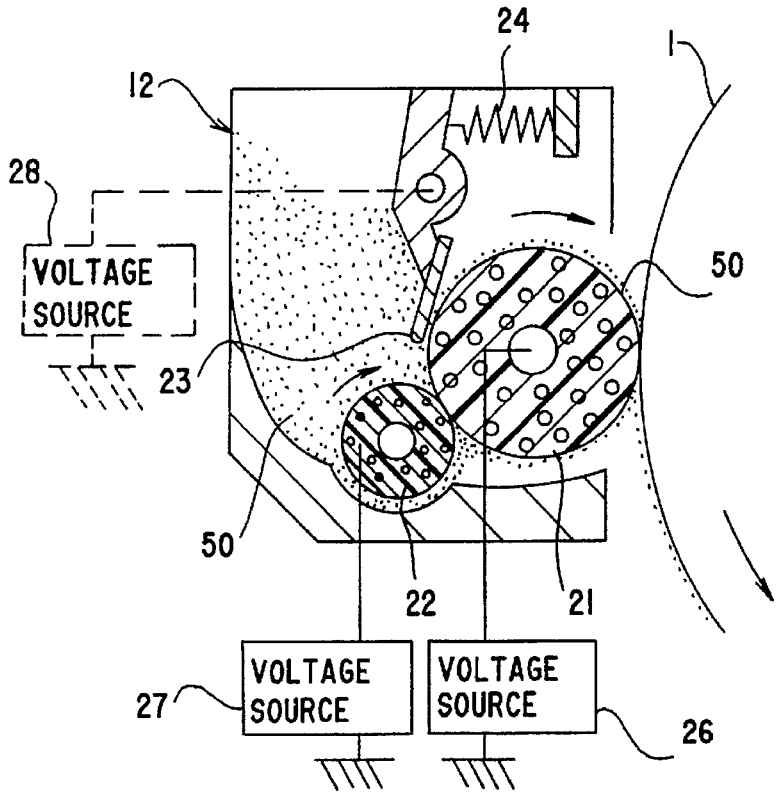
FIG. 2 is a sectional side view of a developing unit in the first embodiment of the present invention.

FIG. 2 shows the developing unit 12 for magenta, selected as an example from among the four developing units 11 to 14 in the developing section 10. The other developing units 11, 13 and 14 for other color toners also have the same arrangement as that of the developing unit 12.

The developing unit 12 is of the mono-component developer type which uses as a developer only non-magnetic toner 50, which is mixed with no magnetic carrier particles. The developing unit 12 uses, for example, polyester toner having a volume resistivity of $4\times10^{-14}$ ohm-cm and an average particle diameter of 12 μm and containing 0.5% a silica additive.

A developing roller (toner transport member) 21 is formed in the shape of a roller by using, for example, an elastic urethane foam material mixed with carbon, for example, to impart electrical conductivity thereto. The developing roller 21 is disposed in pressure contact with the surface of the photosensitive drum 1 and driven to rotate in the same direction as the direction of rotation of photosensitive drum 1 at the contact portion thereof at a constant peripheral velocity higher than that of the photosensitive drum 1.

Figure 3:
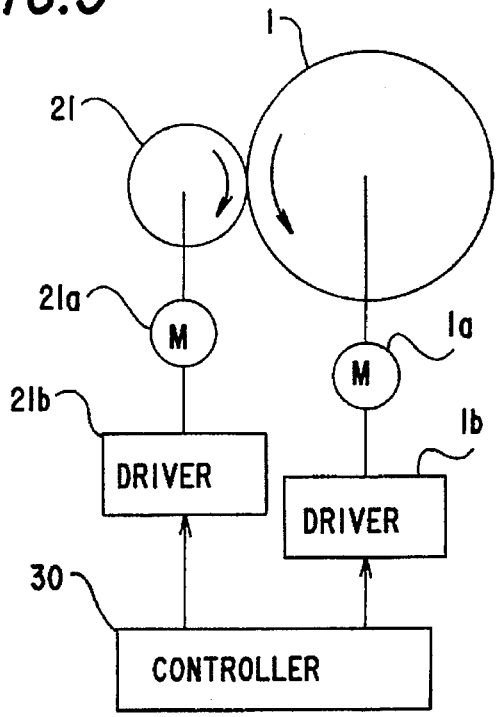
FIG. 3 schematically shows a part of the arrangement of the first embodiment of the present invention.

As shown in FIG. 3, the developing roller 21 and the photosensitive drum 1 are driven by respective step motors 21*a* and 1*a*. A controller 30 having a built-in central processing unit (CPU) and associated elements outputs control signals to driver circuits 21*b* and 1*b* for the motors 21*a* and 1*a*, thereby controlling the respective peripheral velocities of the developing roller 21 and the photosensitive drum 1.

Referring to FIG. 2, a reset roller 22 is disposed in contact with the developing roller 21 in the developing unit 12 and driven to rotate in a direction opposite to the direction of rotation of the developing roller 21 at the contact portion thereof. The reset roller 22 is formed in the shape of a roller by using, for example, an elastic urethane foam material endowed with electrical conductivity. The reset roller 22 is driven by the same motor 21*a* that is used to drive the developing roller 21. An intermediate gear ratio is selected so that the ratio of the peripheral velocity of the reset roller 22 to that of the developing roller 21 is at a predetermined level.

The toner 50 stored in the developing unit 12 is sent to the developing roller 21 by the rotation of the reset roller 22. The thickness of the layer of toner 50 formed on the surface of the developing roller 21 is regulated to a predetermined level by a layer thickness regulating blade 23 made, for example, of a flat stainless steel plate, which is pressed against the surface of the developing roller 21 at a predetermined pressure (e.g., 35 gf/cm) by biasing force from a coil spring 24. Under these conditions, the layer of toner 50 is transported to the photosensitive drum 1.

The toner that remains on the developing roller 21 without moving to the photosensitive drum 1 at the area of contact with the photosensitive drum 1 is recovered from the surface of the developing roller 21 into the developing unit 12 by the contact with the reset roller 22.

DC bias voltage sources 26 and 27 are used to apply bias voltages to the developing roller 21 and the reset roller 22, respectively. For example, −300 V is applied to the developing roller 21, and −400 V to the reset roller 22.

A DC bias voltage source 28 is used to apply a bias voltage to the layer thickness regulating blade 23. For example, −400 V is applied to the layer thickness regulating blade 23. It should be noted that the DC bias voltage source 28 can be removed.

The above-described apparatus of the embodiment was measured for variation in the amount of toner charge with the change of the peripheral velocity ratio of the developing roller 21 and the photosensitive drum 1 and also with the change of the thickness of the toner layer on the developing roller 21.

The peripheral velocity ratio of the developing roller 21 and the photosensitive drum 1 was controlled by changing only the peripheral velocity of the developing roller 21 with the peripheral velocity of the photosensitive drum 1 fixed to 70 mm/sec.

Figure 4:
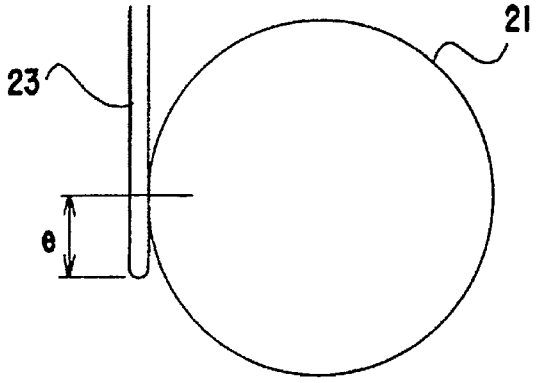
FIG. 4 schematically shows a part of the arrangement of the first embodiment of the present invention.
Figure 5:
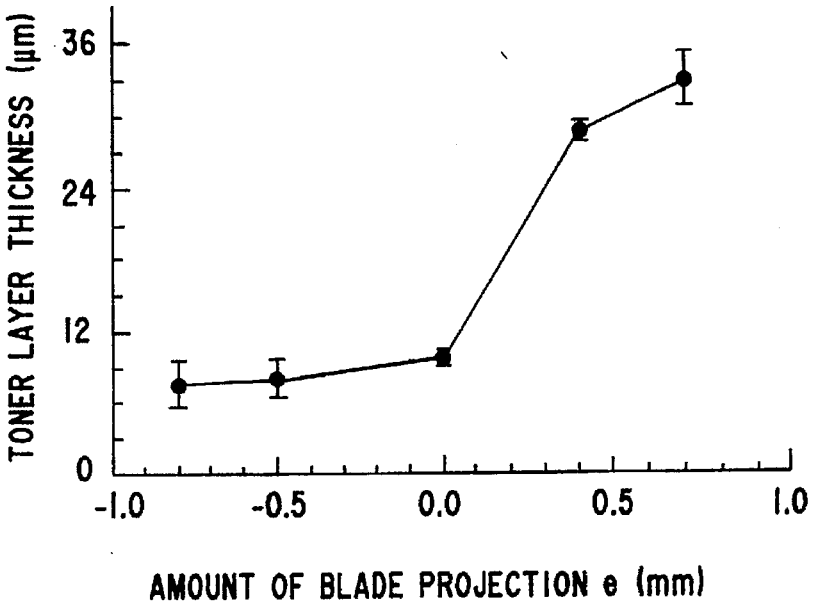
FIG. 5 is a graph showing the relationship between the amount of projection of a toner layer thickness regulating blade and the toner layer thickness in the first embodiment of the present invention.

The thickness of the toner layer on the developing roller 21 was controlled by changing the length e by which the distal end portion of the layer thickness regulating blade 23 projected (i.e., the distance from the center of the area of contact with the developing roller 21 to the distal end of the layer thickness regulating blade 23), as shown in FIG. 4. As will be clear from FIG. 5, the toner layer thickness surely changes with the change of the amount e of projection of the layer thickness regulating blade 23.

Toner is charged by friction occurring when the toner passes through the area between the developing roller 21 and the layer thickness regulating blade 23. The amount of toner charge can be controlled by the peripheral velocity ratio of the developing roller 21 and the developing roller 21, which is controlled by the system shown in FIG. 3, and also the toner layer thickness, which is controlled by the mechanism shown in FIG. 4.

Figure 6:
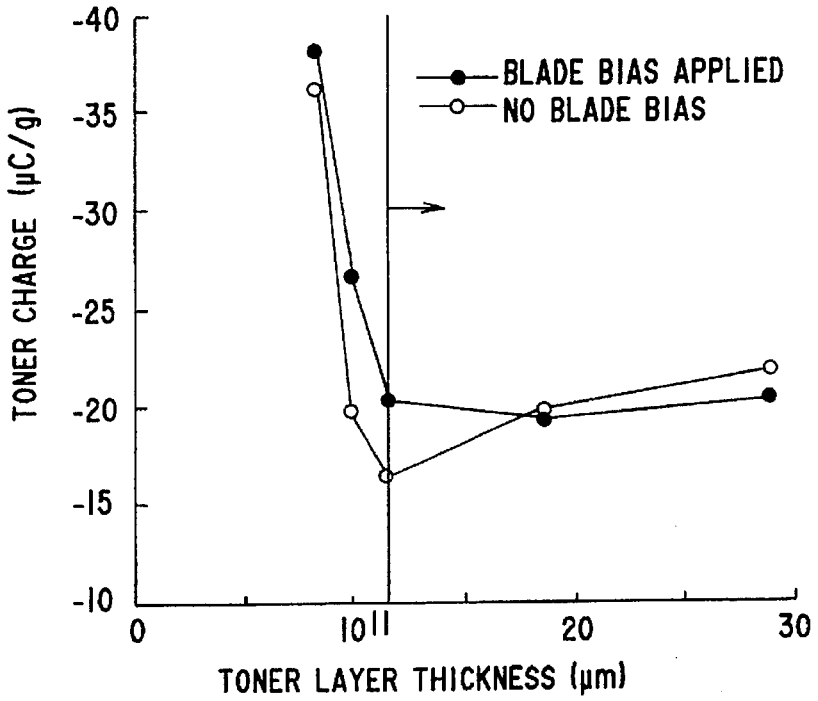
FIG. 6 is a graph showing the relationship between the toner layer thickness and the amount of toner charge in the first embodiment of the present invention.

FIG. 6 shows the relationship between the thickness of the toner layer on the developing roller 21 and the amount of toner charge for a given toner feed rate.

It will be understood from FIG. 6 that in the range where the toner layer thickness is less than 11 μm, the toner charge rapidly changes. Therefore, a slight variation of the toner layer thickness causes the development efficiency to change to a considerable extent. Accordingly, the development quality is likely to degrade. It is therefore preferable to select a toner layer thickness of not less than 11 μm.

Figure 7:
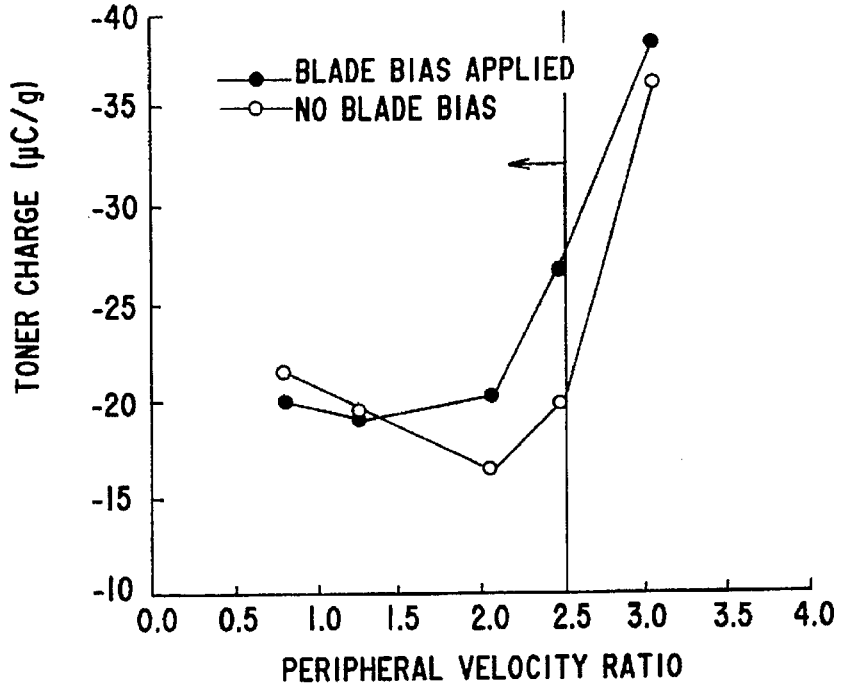
FIG. 7 is a graph showing the relationship between the peripheral velocity ratio and the amount of toner charge in the first embodiment of the present invention.

FIG. 7 shows the relationship between the peripheral velocity ratio of the developing roller 21 and the photosensitive drum 1 and the amount of toner charge for a given toner feed rate.

It will be understood from FIG. 7 that in the range where the peripheral velocity ratio is higher than 2.5, a slight variation of the peripheral velocity ratio causes the toner charge to increase rapidly. Accordingly, the development quality is likely to degrade. Therefore, it is preferable to select a peripheral velocity ratio of not higher than 2.5.

Figure 8:
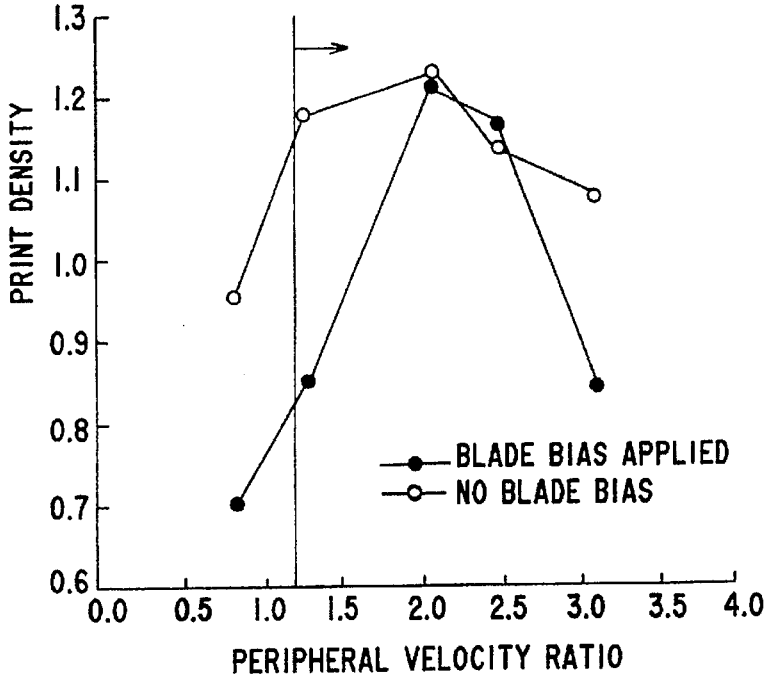
FIG. 8 is a graph showing the relationship between the peripheral velocity ratio and the print density in the first embodiment of the present invention.

In this experiment, the print density, which is approximately proportional to the amount of toner adhering to the photosensitive drum 1, was measured. The results of the measurement are shown in FIG. 8. In the range where the peripheral velocity ratio is lower than 1.2, although the toner charge is favorable, the print density markedly lowers to such a level that the resulting print is unfit for use. Accordingly, it is preferable to select a peripheral velocity ratio of not lower than 1.2.

Figure 9:
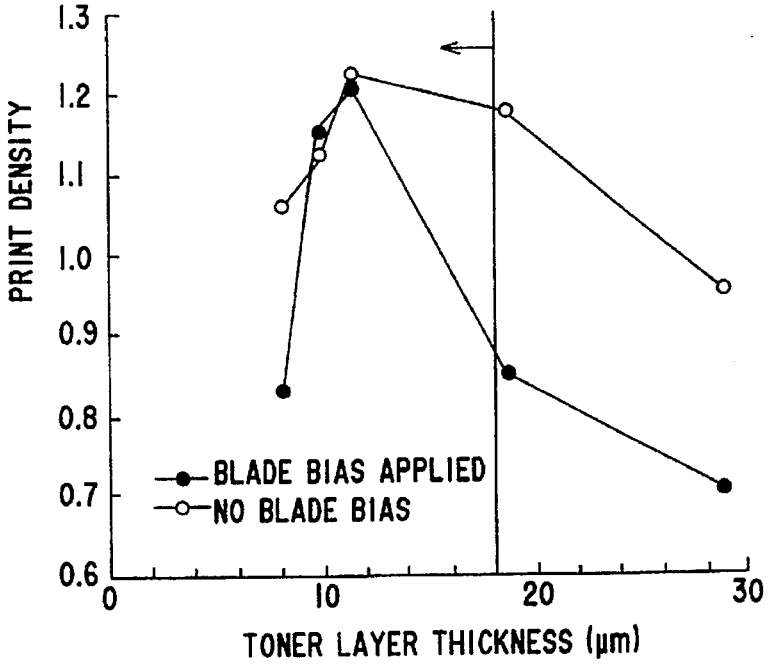
FIG. 9 is a graph showing the relationship between the toner layer thickness and the print density in the first embodiment of the present invention.

FIG. 9 illustrates experimental results showing the relationship between the thickness of the toner layer on the developing roller 21 and the print density. Considering the lowering of the print density, it is preferable to select a toner layer thickness of not more than 18 μm.

As will be understood from FIGS. 6 to 9, when a bias voltage is applied to the layer thickness regulating blade 23, the print density markedly lowers even if the amount of toner charge is the same. Therefore, it is preferable not to apply a bias voltage to the layer thickness regulating blade 23.

When the toner layer thickness is set at not less than 11 μm and the peripheral velocity ratio is set at not higher than 2.5 so that no rapid change of the toner charge occurs under the condition that no bias voltage is applied to the layer thickness regulating blade 23, the toner charge falls within the range of from −16 μC/g to −19 μC/g, as will be understood from FIGS. 6 and 7.

Therefore, a print test was carried out using the apparatus shown in FIG. 1 with the toner charge varied in and near the range of from −16 μC/g to −19 μC/g, and the fog density and the print density were judged. As a result, both the fog and print densities were favorable in the toner charge range of from −16 μC/g to −19 μC/g, as shown in FIG. 10.

Figures 10, 11:
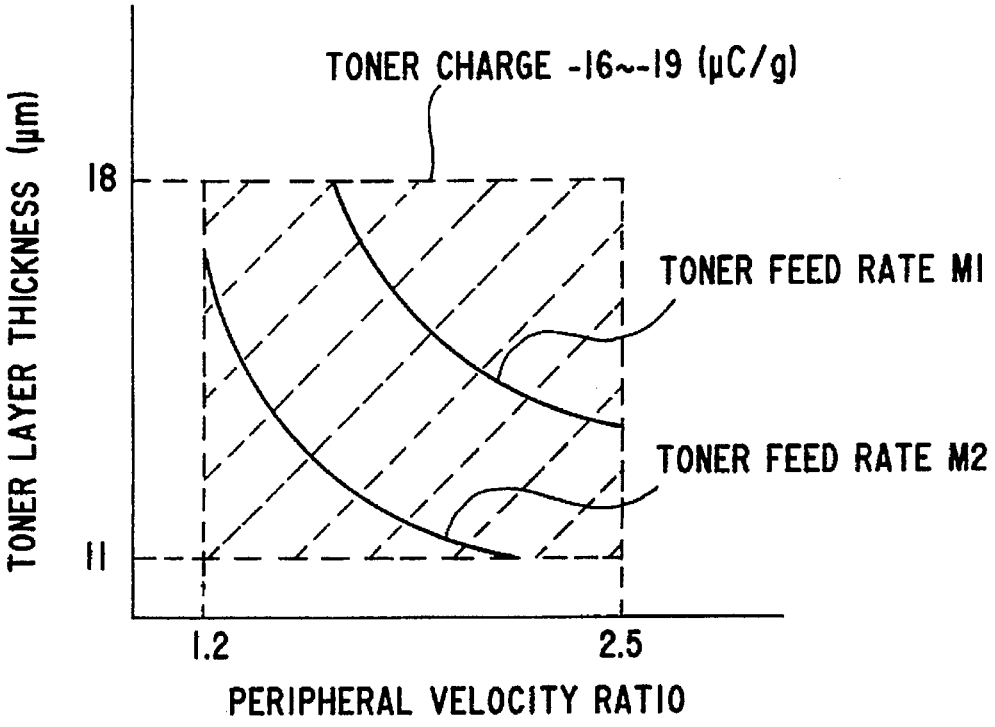
FIG. 10 is a table showing the relationship between the amount of toner charge on the one hand and the fog and print densities on the other in the first embodiment of the present invention.
FIG. 11 is a graph summarizing experimental results in the first embodiment of the present invention.

FIG. 11 is a graph summarizing the results of the above-described experiments. In the range where the peripheral velocity ratio is 1.2 to 2.5 and the toner layer thickness is 11 μm to 18 μm, which is shown by broken slant lines, the toner charge is −16 μC/g to −19 μC/g, and the variation of the development efficiency is small. In addition, the fog density and the print density are favorable. Accordingly, to obtain a given toner feed rate (e.g., M1 or M2), it is preferable to select a combination of a peripheral velocity ratio and a toner layer thickness so that they fall within the range shown by the slant lines in FIG. 11.

Figure 12:
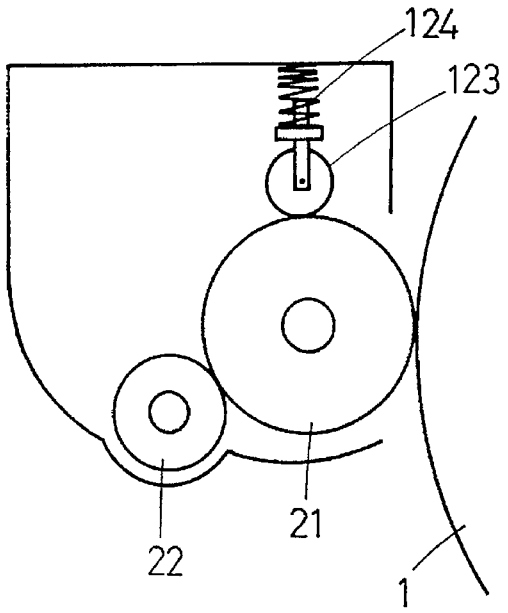
FIG. 12 schematically shows a developing unit in a second embodiment of the present invention.
Figure 13:
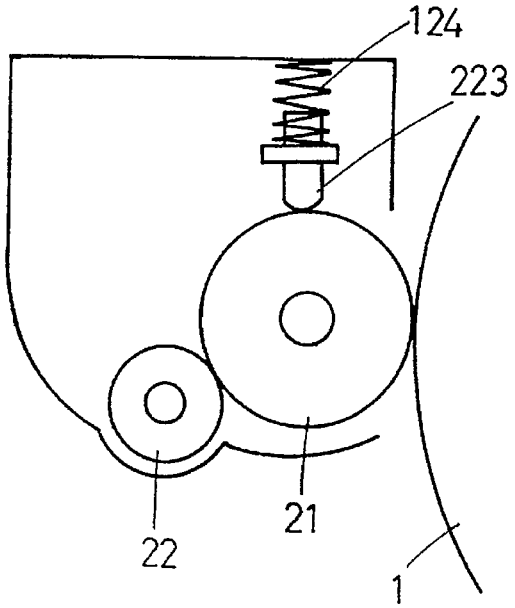
FIG. 13 schematically shows a developing unit in a third embodiment of the present invention.

It should be noted that the developing device to which the present invention is applied is not necessarily limited to that shown in FIG. 2. For example, the layer thickness regulating blade 23 may be replaced with a rotatable roller 123 for regulating the layer thickness, as shown in FIG. 12. In the alternative arrangement, the roller 123 is vertically pressed against the developing roller 21 to regulate the toner layer thickness to a predetermined level, and the toner layer thickness is controlled by changing the biasing force of a coil spring 124. It is also possible to vertically press the distal end of a rod 223 against the developing roller 21, as shown in FIG. 13.

According to the present invention, even when the peripheral velocity ratio of the toner transport member and the image transport member or the thickness of the toner layer on the toner transport member varies from a set value, the toner charge shifts only slightly, and hence the development efficiency does not considerably change. Accordingly, the amount of toner supplied from the toner transport member to the image transport member is stabilized and becomes uniform. Thus, favorable development quality can be obtained.

Furthermore, a thickness of toner layer and peripheral speeds of a photosensitive drum and a developing roller are not required to be accuracy, so an assembling of a full-color printer is eased, and therefore a manufacturing cost will be lowered.

While the invention has been described by reference to specific embodiments chosen for purposes of illustration, it should be apparent that numerous modifications could be made thereto by those skilled in the art without departing from the basic concept and scope of the invention.

We claim:

1. An image forming apparatus, comprising:

image transport means driven to rotate with a latent image formed on a surface thereof;

toner transport means driven to rotate with toner attached thereto for developing said latent image and in contact with said image transport means to transport said toner to said image transport means;

toner layer thickness regulating means disposed in pressure contact with the surface of said toner transport means to regulate a thickness of a layer of toner transported in a state of being attached to the surface of said toner transport means;

means, operably coupled to said toner transport means, for regulating a thickness of a toner layer on the surface of said toner transport means; and means for cleaning said image transport means after said latent image has been developed, wherein the amount of charge of the toner on the surface of said toner transport means being within the range of between −16 μC/g and −19 μC/g by which the thickness of the toner layer of said toner transport means is regulated within a range of between 11 μm and 18 μm and by which said toner transport means is driven to rotate in the same direction as a direction of rotation of said image transport means at an area of contact therebetween at a peripheral velocity which is between 1.2 and 2.5 times a peripheral velocity of said image transport means.

2. An image forming apparatus according to claim 1, wherein said latent image is an electrostatic latent image formed by an electric potential different from an electric potential at the other portion of the surface of said image transport means.

3. An image forming apparatus according to claim 2, wherein said toner is non-magnetic, and said toner alone is transported by said toner transport means.

4. An image forming apparatus according to claim 3, wherein said toner transport means is an electrically conductive and elastic roller-shaped member.

5. An image forming apparatus according to claim 4, wherein a bias voltage is applied to said toner transport means.

6. An image forming apparatus according to claim 1, wherein said image transport means is driven to rotate at a peripheral velocity of 70 mm/sec.

7. An image forming apparatus according to claim 1, wherein the thickness of the toner layer on the surface of said toner transport means is regulated to a thickness in the range of from 11 μm to 18 μm by said toner layer thickness regulating means.

8. An image forming apparatus according to claim 7, wherein no bias voltage is applied to said toner layer thickness regulating means.

9. An image forming apparatus according to claim 1, wherein said toner layer thickness regulating means is a plate-shaped member pressed against the surface of said toner transport means.

10. An image forming apparatus according to claim 1, wherein said toner layer thickness regulating means is a rotatable roller-shaped member pressed against the surface of said toner transport means.

11. An image forming apparatus according to claim 1, wherein said toner layer thickness regulating means is a rod-shaped member pressed against the surface of said toner transport means.

12. An image forming apparatus according to claim 1, which is an electrophotographic apparatus.

13. An image forming apparatus according to claim 12, which is a full-color electrophotographic apparatus designed to form a full-color image by superimposing a plurality of toner images of different colors.

14. An image forming apparatus, comprising:

an endless latent image carrier, a surface moving velocity of said endless latent image carrier being at a first velocity; and a plurality of developing units, each developing unit including:

a toner having a color, the color of the toner being different from a color of toner used in other developing unit, a developing roller, wherein the developing roller carries the toner to said endless latent image carrier, and wherein a surface moving velocity of the developing roller is a second velocity, and a blade, wherein the blade regulates a thickness of a toner layer on a surface of the developing roller, wherein the second velocity of each developing unit is between 1.2 and 2.5 times the first velocity, and wherein the thickness of the toner layer of each developing unit is within a range of between 11 μm and 18 μm.

* * * * *